United States Patent [19]

Pedersen et al.

[11] 4,081,872

[45] Apr. 4, 1978

[54] SUBMERGED SELF-STABILIZED CARGO HOSE ARM FOR A SINGLE POINT MOORING SYSTEM

[75] Inventors: Kristen I. Pedersen, Scarsdale, N.Y.; William L. Kiely, Houston, Tex.

[73] Assignee: Sofec, Inc., Houston, Tex.

[21] Appl. No.: 718,459

[22] Filed: Aug. 30, 1976

[51] Int. Cl.[2] ..... B63B 21/00; B65B 3/04

[52] U.S. Cl. ..... 9/8 P; 114/230; 141/387; 137/236 S

[58] Field of Search ..... 114/230; 9/8 P; 137/236; 141/387, 388

[56] References Cited

U.S. PATENT DOCUMENTS

| | | | |
|---|---|---|---|
| 3,479,673 | 11/1969 | Manning | 114/230 |
| 3,883,912 | 5/1975 | Pederson | 9/8 P |
| 3,942,204 | 3/1976 | Gruy | 114/230 |
| 4,010,500 | 3/1977 | Reid | 114/230 |

FOREIGN PATENT DOCUMENTS

| | | | |
|---|---|---|---|
| 1,177,926 | 1/1970 | United Kingdom | 9/8 P |

*Primary Examiner*—Stanley H. Tollberg
*Assistant Examiner*—Edward M. Wacyra
*Attorney, Agent, or Firm*—Bertram H. Mann

[57] ABSTRACT

A single anchor leg mooring and tanker cargo transfer system has a base with an anchor leg pipe shaft having a horizontally swiveling housing thereon to which are attached vertically pivoting cargo hose arms. The arms have widely spaced, parallel portions extending a substantial distance beyond the base portion for augmenting the torque applied to the swivels by the cargo hoses. The hose arms are stabilized and limited in their vertical pivoting by a balanced lever structure pivotally mounted on the base and carrying buoyancy tanks. Bumpers limit the vertical pivoting of the lever structure flexing of the hose arms secured thereto.

6 Claims, 3 Drawing Figures

A
B
C
D
E
G
H
I
J
K
3
3
7
9
15
34
40

SUBMERGED SELF-STABILIZED CARGO HOSE ARM FOR A SINGLE POINT MOORING SYSTEM

BACKGROUND OF THE INVENTION

In Pedersen U.S. Pat. No. 3,883,912, assigned to the assignee of the present application, there is disclosed a single anchor leg mooring system in which converging, vertically and horizontally swiveling submerged hose arms terminate at a support float counterbalanced by a depending weight. This arrangement will permit vertical angular movements which will relieve vertical bending strains in the cargo hoses due to dynamic and static forces acting on the hose, and at the same time resist excessive deviations from the desired optimum angle of inclination of the hose arm. Excessive variations from the optimum angle of inclination will significantly reduce the torque effect of the hose arm.

The ability of the arrangement disclosed in U.S. Pat. No. 3,883,912 to resist vertical movements of the hose arm is proportional to the physical dimensions of the buoyancy tank and counterweight structure. For large cargo swivels with relatively high torque resistance, the effective embodiment of this arrangement may require very large physical dimensions in order to provide adequate resistance against being pulled upward to the extent that horizontal torque capacity is reduced to a value which is insufficient to overcome the actual torque resistance of the cargo swivel. Such large dimensions, particularly with respect to height requirements, cannot always be accommodated, and the arrangement is found to be impractical at locations where the vertical clearance between the tanker keel and the sea bottom limits the space available for such hose arm arrangements.

SUMMARY OF THE PRESENT INVENTION

In accordance with the present invention, the converging portions of the cargo hoses are located outwardly beyond the hose support arm supporting float which is carried on one arm of a V-shaped structure pivotally mounted on the anchor leg. The vertical swinging of the hose arms is restrained by provision of a counterbalancing float on the opposite leg of the V-structure and bumper means which provide fixed limits to the pivoting of the V-structure and the hose arms.

In contrast to the above mentioned prior art limitations, a hose arm constructed in accordance with the present invention requires relatively small vertical clearances and will include other operational advantages not provided by previously disclosed systems.

BRIEF DESCRIPTION OF THE DRAWING

In the accompanying drawings

DETAIL DESCRIPTION OF THE DRAWINGS

Figure 1:
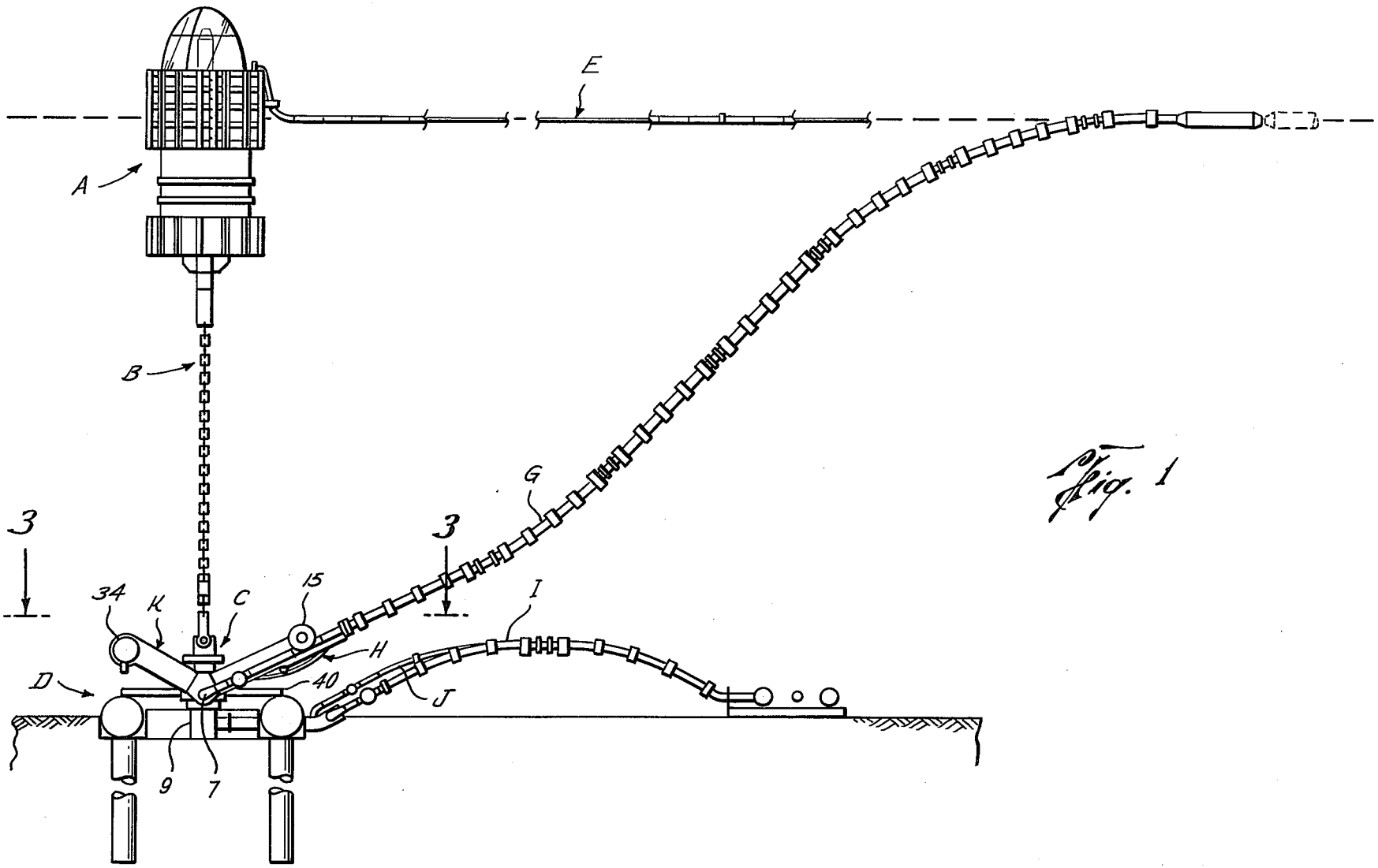
FIG. 1 is an elevational view of a single anchor leg mooring and cargo transfer system illustrating the invention.

FIG. 1 shows a mooring buoy A secured by a chain B and universal joint C to the anchoring base, generally designated D. A mooring line E connects with the buoy A and main and supplementary fluid cargo hoses F, G, and H and ground or base hoses I and J connect with the base D, as will be described. Internal connections between the cargo and base hoses are described in detail in co-pending application Ser. No. 540,551 filed Jan. 13, 1975, and assigned to the assignee of the present application, now U.S. Pat. No. 3,942,204.

Figure 3:
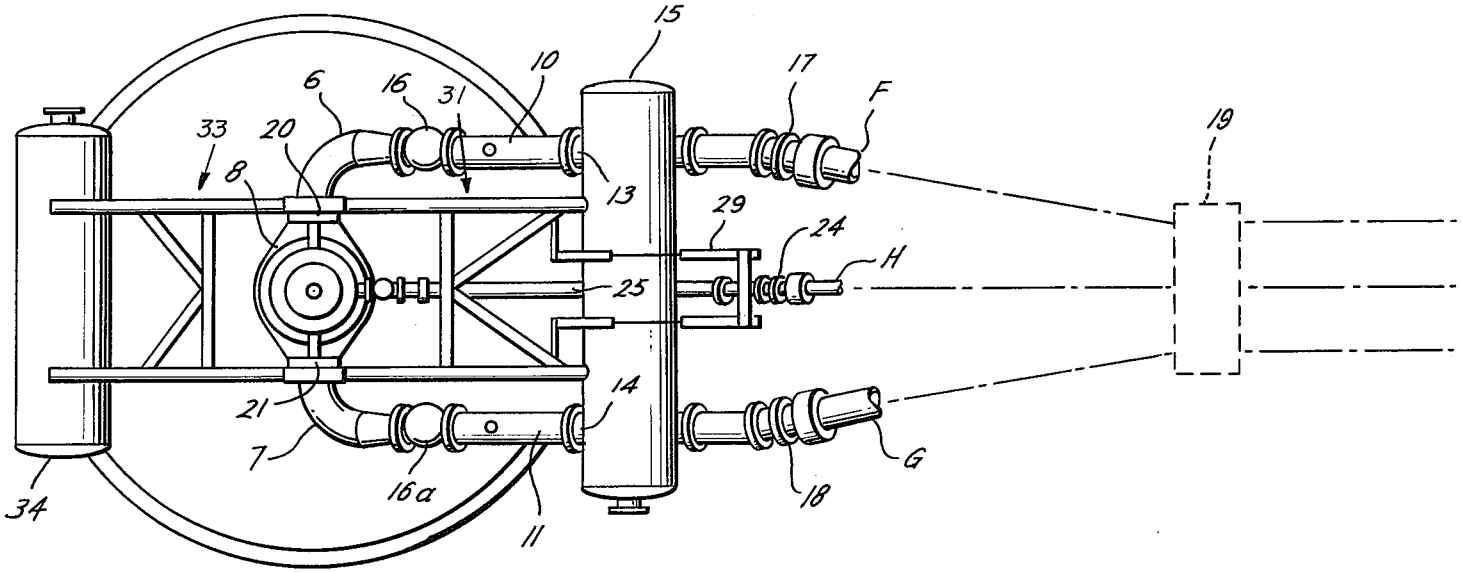
FIG. 3 is a plain view of the structure in FIG. 2 taken on line 3—3 of FIG. 1.

As shown in FIG. 3, a pair of hose pipes or arms 6 and 7 project diametrically oppositely from a swivel housing 8, sealingly rotatable upon the anchor leg pipe 9 (see said U.S. Pat. No. 3,942,204), then turn normally to form widely spaced parallel portions 10 and 11 for coupling to short pipe sections 13 and 14 formed on the bottom and transversely of cargo hose stabilizing float tank 15. Arm portions 6 and 10 and 7 and 11 are joined by couplings on shut-off valves 16 and 16*a*. Couplings 17 and 18 provide for connection of the terminal portions of cargo hoses F and G, which converge to a spreader bar 19 spaced one section away from the hose arm end couplings 17 and 18 for a purpose to be described. Thence, the hoses proceed at optimum spacing to the vessel or other location being serviced. Angled hose arms 6 and 7 have rugged journal bearings 20 and 21 in swivel housing 8 to permit vertical swinging of the cargo hoses, while horizontal swinging of the hoses is permitted by swivel housing 8 under torque applied through the cargo hoses as the connected vessel swings about the mooring buoy.

The additional fluid hose H, for instance, for bunker fuel, is connected through a separate swivel housing 27 and a separate pipe in anchor leg pipe 8 to round pipe J, also as disclosed in said U.S. Pat. No. 3,942,204. Coupling 24 is supported from buoyancy tank 15 by a bracket 29.

Figure 2:
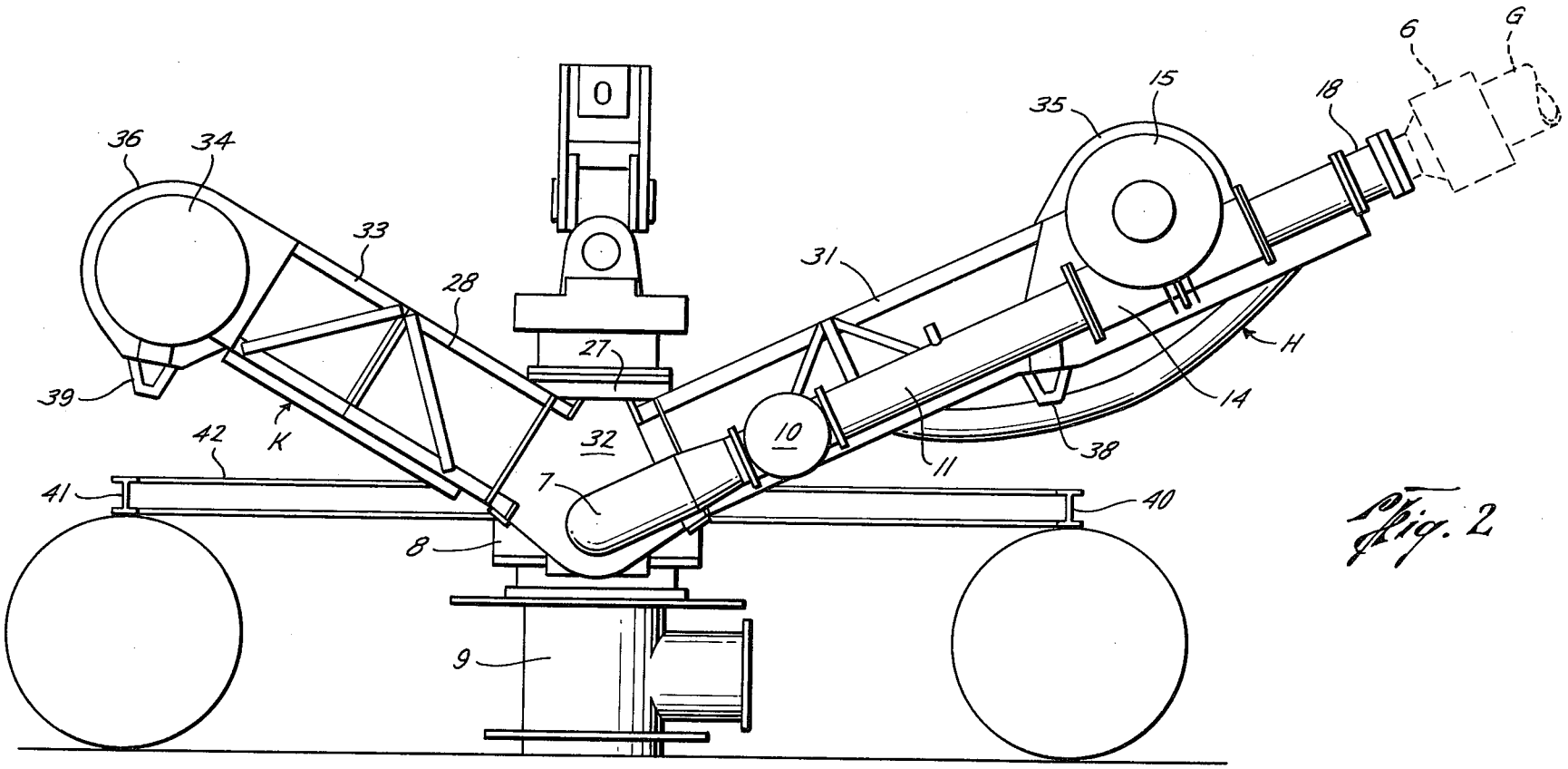
FIG. 2 is an enlarged view of a portion of the structure in FIG. 1.

As best shown in FIG. 2, buoyancy tank 15 is carried at the outer end of one arm 31 of a wide V-shaped stabilizing structure, generally designated K. The apex portions 32 of structure K are rigidly mounted on pivotal radial hose arm portions 6 and 7. The outer ends of lever arms 31 and 33 of the stabilizing structure are secured to buoyancy tanks 15 and 34 by tanks embracing brackets 35 and 36. Thus, the entire stabilizing structure rocks with and stabilizes the hose arms. Buoyancy members 15 and 34 are located substantially above the level of the pivotal mounting of structure K, so that as one buoyancy member 15 or 34 rises to reduce its effective horizontal lever arm, the other buoyancy member lowers to increase its effective lever arm and thereby exercise an increasing stabilizing effect.

Depending from both buoyancy tanks 15 and 34 are bumpers 38 and 39 located substantially directly above bumper rails 40 and 41 at the periphery of anchor base platform 42.

OPERATION AND ADVANTAGES

The operational purpose of the hose arm is to provide a lever arm which will permit the flexible cargo hose to exert a horizontal torque effect on the cargo swivel. The effective length of the lever arm must be adequate to develop enough torque to overcome inherent resistance to swivel rotation without causing excessive bending strains in the cargo hose.

The hose arm must also accomodate vertical movements of the flexible hose, due to dynamic and static forces acting on the hose, without causing excessive vertical bending strains in the hose at the connection to the hose arm. Thus, the hose arm is pivoted to the vertical pipe-shaft to allow vertical movement, yet must be restrained against excessive deviations from the desired optimum vertical inclination of the hose arm, as such deviations will reduce the horizontal component of the effective lever arm.

In the present invention, the wide spacing of the parallel hose arm extension portions 10 and 11 for a substantial distance outwardly from the anchor leg structure to beyond buoyancy tank 15 has the advantage of allowing a large horizontal spacing between the ends of the first hose sections (F and G). The large spacing of the flexible hose at this point has the effect of substantially reducing the bending strains in these sections of the flexible cargo hose. Such strains tend to cause buckling of the hoses in the vertical plane and any reduction in the magnitude of these axial forces is therefore beneficial and will increase the effective lever arm provided by the system for transmission of torque between the cargo hoses and the anchor leg swivels. This effect is one important improvement over previous hose arm systems wherein dual flexible hoses are maintained parallel and at close or uniform spacing all the way to the rigid hose arm.

The two balanced buoyancy tanks 15 and 34 derive their stabilizing effect against excessive vertical movements of the hose arm from the fact that their combined center of buoyancy is located at an elevation substantially above the pivotal axis of hose arm portions 6 and 7. The magnitude of the stabilizing effect is directly proportional to the total net buoyancy of the tanks and to the vertical distance between the pivotal axis and the combined center of buoyancy of the tanks.

The stabilizing moment described above normally will prevent contact between the bumpers (38 and 39) and the bumper rail (40) and assures that the torque resistance of the swivel is not augmented by friction between the bumpers and the bumper rail.

Finally, a primary advantage of the invention resides in the fact that the overall height of the anchor leg structure is substantially reduced due to the generally horizontal disposition of the lever arms 15 and 34 of the stabilizing structure. This has the advantage of adapting the system for use in relatively shallow water.

The invention may be modified in various respects as will occur to those skilled in the art and the exclusive use of all modifications as come within the scope of the appended claims is contemplated.

What is claimed is:

1. A single anchor leg mooring and cargo transfer system of the type described comprising anchor base means including a sea-floor base and a pipe shaft extending upwardly from said base, a cargo hose arm having a pivotal mounting on said pipe shaft and capable of swivelling action relative to said base means about horizontal and vertical axes, stabilizing structure having pivotal mounting on said base means and having lever arms extending oppositely from said pipe shaft, one of said lever arms supporting said hose arm, and buoyancy members carried by said lever arms for tending to maintain said hose arm and coupled hose in optimum position.

2. A single anchor leg mooring and cargo transfer system as described in claim 1 in which said buoyancy members are spaced from the pivotal axis of said stabilizing structure and of such buoyancy as to resist departure of said hose arms from optimum positioning relative to said pipe shaft.

3. A single anchor leg mooring and cargo transfer system as described in claim 2 in which said buoyancy members are located substantially above the level of said pivotal mounting.

4. A single anchor leg mooring and cargo transfer system as described in claim 3 further including bumper means engageable by at least one of said stabilizer arms during pivoting thereof to limit vertical swinging of said hose arms and hoses coupled thereto.

5. A single anchor leg mooring and cargo transfer system as described in claim 3 further including an additional hose independently coupled to said base means and also supported by the corresponding buoyancy member.

6. A single anchor leg mooring and cargo transfer system as described in claim 1 in which said hose arms are journaled in said base means for vertical swivelling movements and extend along one arm of said stabilizing structure, said hose arms adjacent their extremities being secured to the buoyancy member on said latter stabilizing arm.

* * * * *